US007030751B2

(12) United States Patent
Malot et al.

(10) Patent No.: US 7,030,751 B2
(45) Date of Patent: Apr. 18, 2006

(54) PROCESS FOR OPERATING A SECURITY SYSTEM FOR THE PROTECTION OF PERSONS AND BELONGINGS

(75) Inventors: Jean Malot, Saint Martin D'Uriage (FR); Jean-Pierre Villeroy, Vaulnavey-le-Bas (FR); Gilles Morey, Saint Ismier (FR)

(73) Assignee: ATRAL, Crolles (FR)

( * ) Notice: Subject to any disclaimer, the term of this patent is extended or adjusted under 35 U.S.C. 154(b) by 189 days.

(21) Appl. No.: 10/801,535

(22) Filed: Mar. 17, 2004

(65) Prior Publication Data

US 2004/0212491 A1 Oct. 28, 2004

(30) Foreign Application Priority Data

Mar. 17, 2003 (FR) ..... 03 03253
Jun. 3, 2003 (FR) ..... 03 06690

(51) Int. Cl.
*G08B 23/00* (2006.01)

(52) U.S. Cl. ..... 340/528; 340/527

(58) Field of Classification Search ..... 340/528, 340/527, 521, 541, 506, 523, 545.1, 430
See application file for complete search history.

(56) References Cited

U.S. PATENT DOCUMENTS 3,757,319 A * 9/1973 Hedin ..... 340/528
3,787,832 A * 1/1974 Bolinger ..... 340/528
3,968,474 A * 7/1976 Danahey ..... 340/430
4,338,493 A 7/1982 Stenhuis et al.
5,434,556 A * 7/1995 Donohoo ..... 340/547
5,949,333 A * 9/1999 Lehmann et al. ..... 340/571
6,078,254 A * 6/2000 Parker ..... 340/514
6,127,921 A * 10/2000 Gullner et al. ..... 340/426.26
6,249,225 B1 * 6/2001 Wang ..... 340/545.9

FOREIGN PATENT DOCUMENTS

DE 196 31 665 2/1998
EP 0 117 251 8/1984

* cited by examiner

*Primary Examiner*—John Tweel, Jr.
(74) *Attorney, Agent, or Firm*—Young & Thompson

(57) ABSTRACT

Process for operating a security system, for the protection of persons and belongings, comprising a warning device (2) triggerable by a control unit (3), a unit (11) for activating a signalling device (7) and a means (6) of unlocking an electrically controlled lock (5), this process consisting:—in activating a timeout unit when the control unit is invoked so as to engage a timeout interval (T1),—in activating the element for unlocking the lock when the said activation unit is invoked during the timeout interval (T1), and in disabling the signalling device during the aforesaid timeout interval (T1) so that this signalling device can be activated only if the said activation unit is invoked outside of the timeout interval (T1).

7 Claims, 4 Drawing Sheets

PROCESS FOR OPERATING A SECURITY SYSTEM FOR THE PROTECTION OF PERSONS AND BELONGINGS

BACKGROUND OF THE INVENTION

The present invention relates to the field of the security of persons and belongings.

Systems for calling for help are already known, said systems comprising a portable object furnished with a button which, when it is invoked, activates, by remote control, a signalling device such as a warning siren in the vicinity and/or a remote warning telephone transmitter.

Systems are known moreover which allow an outside person to warn a person in his or her home and which allow the latter to activate, by virtue of a button, the unlocking of an electric unit for closing a door for access to this home.

An aim of the present invention is to combine such systems in order to improve the security and comfort of persons in their home, in particular of senior citizens with reduced mobility.

SUMMARY OF THE INVENTION

For this purpose, a subject of the present invention is a process for operating a security system comprising a warning device triggerable by a control unit, a unit for activating a signalling device and a means of unlocking an electrically controlled lock.

The process according to the invention consists: in activating a timeout unit when the control unit is invoked so as to engage a timeout interval (T1),—in activating the means of unlocking the lock when the said activation unit is invoked during the timeout interval (T1),—and in disabling the signalling device during the aforesaid timeout interval (T1) so that this signalling device can be activated only if the said activation unit is invoked outside of the timeout interval (T1).

According to the invention, a new timeout interval (T1) cannot preferably be engaged until after the elapsing of a security interval (T3) subsequent either to an earlier timeout interval (T1) previously engaged when the said activation unit has not been invoked during the timeout interval (T1), or upon the activation of the means for unlocking the lock when the said activation unit has been invoked during the timeout interval (T1).

According to the invention, the process preferably consists in prolonging the disabling of the signalling device during a protection interval (T2) subsequent either to an earlier timeout interval previously engaged (T1) when the said activation unit has not been invoked during the timeout interval (T1), or upon the activation of the means for unlocking the lock when the said activation unit has been invoked during the timeout interval (T1).

According to the invention, the aforesaid protection interval (T2) is less than the aforesaid security interval (T3).

According to the invention, the process can advantageously consist in activating the said warning device according to a different mode of operation and/or in activating the said unlocking means when a supplementary control unit is invoked.

According to the invention, the signalling device may advantageously be able to activate the said unlocking means after having been invoked.

BRIEF DESCRIPTION OF THE DRAWING

The present invention will be better understood on studying a security system and its method of operation, which are described by way of nonlimiting examples and illustrated by the drawing in which.

DESCRIPTION OF THE PREFERRED EMBODIMENTS

Figure 1:
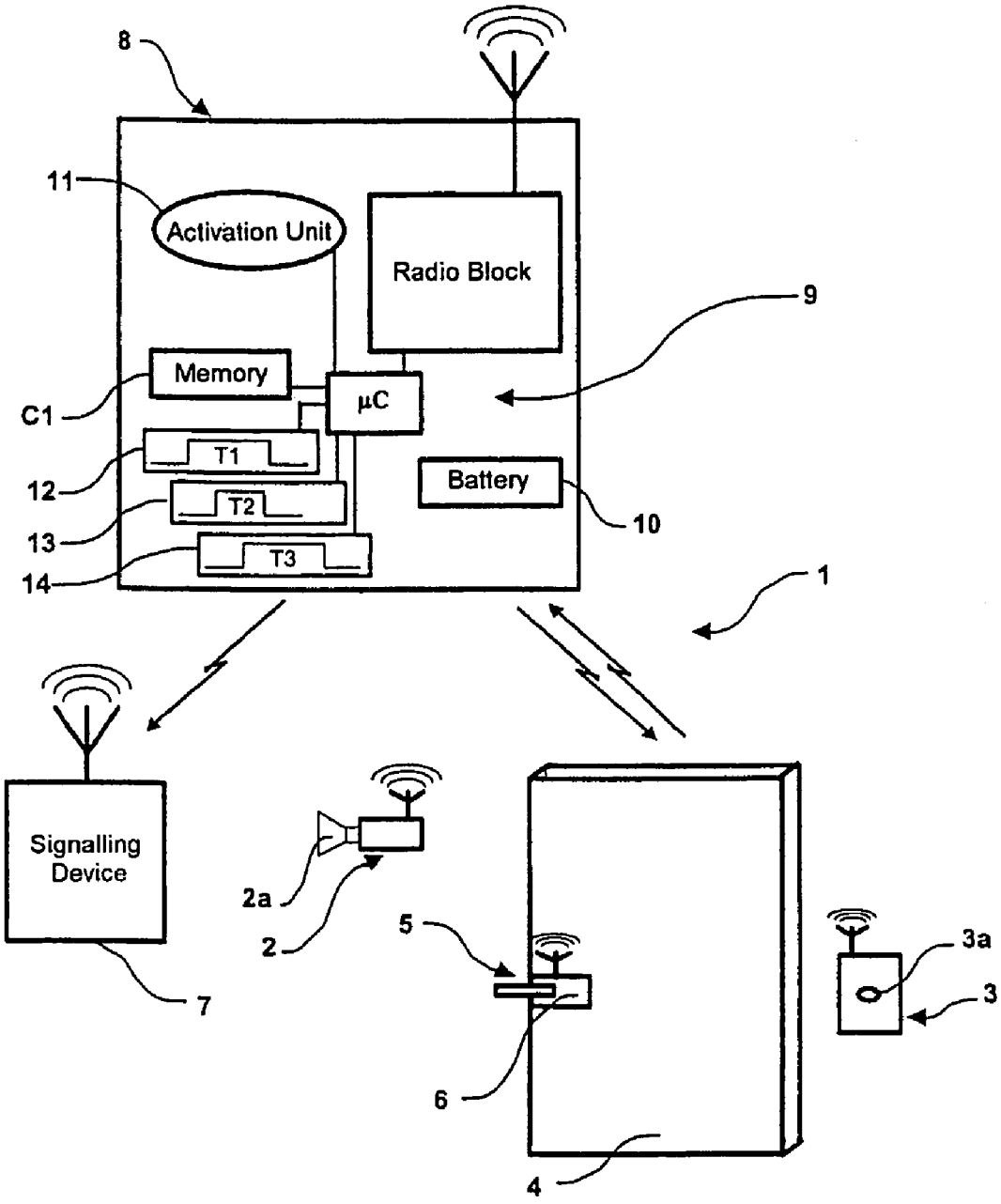
FIG. 1 represents a general diagram of a security system according to the invention.

Referring to FIG. 1, it may be seen that represented therein is a security system 1 intended to be installed and used by one or more persons living in a home.

This security system 1 comprises a warning device 2 comprising for example a buzzer 2*a*, located inside the home, associated with an exterior control unit 3 furnished with an exterior push button 3*a*.

The exterior control button 3*a* is located in proximity to a door 4 for access to the home. This door 4 is furnished with an electrically controlled lock 5 controlled by an electromagnet for example which comprises an unlocking means 6 actuating this electromagnet.

The security system 1 furthermore comprises a device 7 for signalling or for calling for help which can for example consist of a siren located outside the home and/or a telephone transmitter for transmitting a message calling for help linked to the public telephone network so as to remotely warn one or more parties or a monitoring or emergency centre.

The security device 1 also comprises a portable housing 8, such as a pendant, or any object that can easily be carried by a person. This portable housing 8 encloses an electronic circuit 9 powered for example by a battery 10 and is furnished with an activation unit 11 such as a push button linked to the electronic circuit 9.

In a general manner known per se, in the example now described, the aforesaid components of the security system 1 comprise electronic circuits furnished with radio emitters and/or receivers so that they can be linked and thus communicate with one another by radio, exchanging specially coded radio signals. More particularly, the exterior control unit 3 is linked by radio to the electronic circuit 9 of the portable housing 8 and the latter is linked by radio to the means 6 for unlocking the door 4, to the warning device 2 and to the signalling device 7, the portable housing 8 thus playing the role of a central facility.

The electronic circuit 9 of the portable housing 8 is programmed to recognize the radio signal emitted by the exterior control unit 3 by comparison with an expected signal contained in a code memory C1 and is programmed to manage control orders as will be described later.

The electronic circuit 9 of the portable housing 8 is also suitable for being subjected to a timeout interval T1, to a protection interval T2 and to a security interval T3 of a duration greater than the interval T2, these intervals preferably being adjustable by virtue for example of potentiometers 12, 13 and 14 included in the portable housing 8.

The security system 1 just described can, in an example, be programmed to operate in the following fashion.

Figure 2:
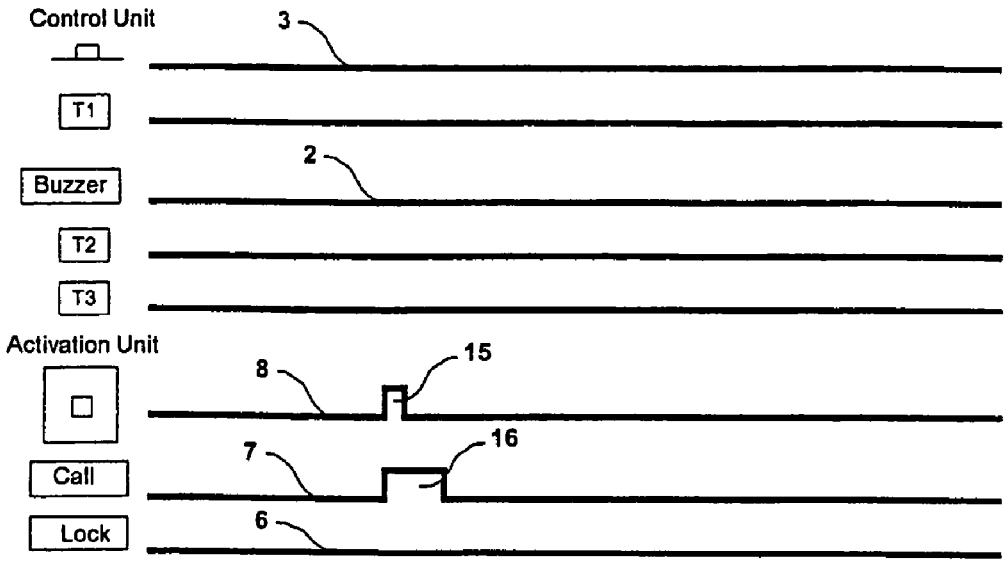
FIGS. 2 to 5 represent various timing charts of the operation of the security system of FIG. 1.

The manner in which the security system 1 operates in the case where the button 3*a* of the control unit 3 is not invoked will be described while referring to FIG. 2.

If the person furnished with the portable housing 8 invokes this housing's activation unit 11 at any moment, the electronic circuit 9 emits a radio signal 15 which, being received and understood by the signalling device 7, activates the latter to emit a signal 16 calling for help. In the case of an exterior siren, this siren is activated and in the case of a telephone transmitter, this telephone transmitter is activated in such a way as to automatically seize a telephone line to at least one particular call number and transmit a message calling for help.

The case where the button 3*a* of the control unit 3 is invoked and the unit 11 for activating the portable housing 8 is not invoked will now be described while referring to FIG. 3.

When the button 3*a* of the exterior control unit 3 is invoked by a person located outside the home, this unit 3 emits a radio signal 17 which, being received and understood by the electronic circuit 9 of the portable housing 8, triggers the timeout interval T1 and emits a signal to the warning device 2 to activate the buzzer 2*a* according to the reference 18.

At the end of the timeout interval T1, the electronic circuit 9 of the portable housing 8 emits a signal which, being received by the warning device 2, deactivates the buzzer 2*a* and the electronic circuit 9 engages the security interval T2 and the protection interval T3.

For the duration corresponding to the addition of the timeout interval T1 and of the security interval T3, any new invoking of the button 3*a* of the exterior control unit 3 is disregarded by the electronic circuit 9 of the portable housing 8.

On completion of this duration, that is to say on completion of the interval T3, the system 1 is again in the state described with reference to FIG. 2.

Figure 4:
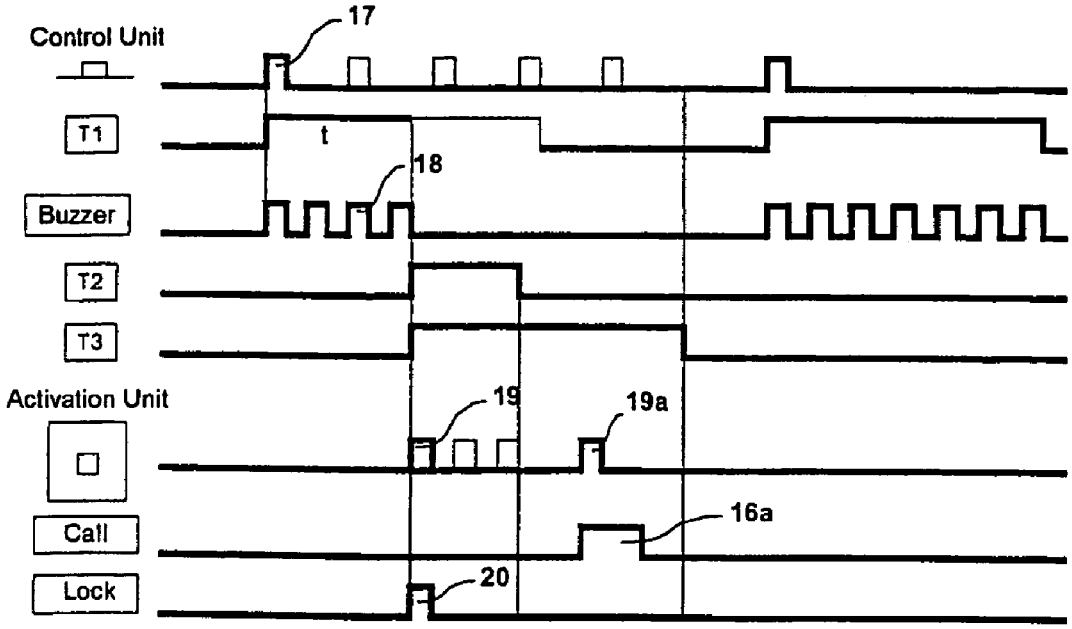

The case where the button 3*a* of the exterior control unit 3 is invoked and/or the unit 11 for activating the portable housing 8 is invoked by the timeout interval T1 will now be described while referring to FIG. 4.

As in the case described with reference to FIG. 3, the signal 17 emitted by the exterior control unit 3, subsequent to an invoking of the button 3*a* by a person outside the home, causes the starting of the timeout interval T1 of the electronic circuit 9 of the portable housing 8 and this circuit 9 emits a control signal for the warning device 2 so as to activate the buzzer 2*a* according to the reference 18.

If the person furnished with the portable housing 8 invokes the unit 11 for activating this housing in the course of the timeout interval T1 according to the reference 19, namely on expiry of a duration t, its electronic circuit 9 emits a radio signal which, being received and understood by the unlocking means 6, brings about the unlocking of the electric lock 5 according to the reference 20. The person outside is then permitted to enter the home.

Likewise, when the person invokes the unit 11 for activating the portable housing 8, the electronic circuit 9 of this housing engages the protection interval T2 and the security interval T3.

During this protection interval T2, any new invoking of the activation unit 11 has no effect. On the other hand, on completion of this protection interval T2, an invoking 19*a* of the unit 11 for activating the housing 8 gives rise to the activation of the signalling device 7 according to the reference 16*a*.

For a duration corresponding to the addition of the interval t and of the security interval T3, any new invoking of the button 3*a* of the exterior control unit 3 produces no effect.

On completion of this duration, that is to say on completion of the interval T3, the system 1 is again in the state described with reference to FIG. 2.

Figure 3:
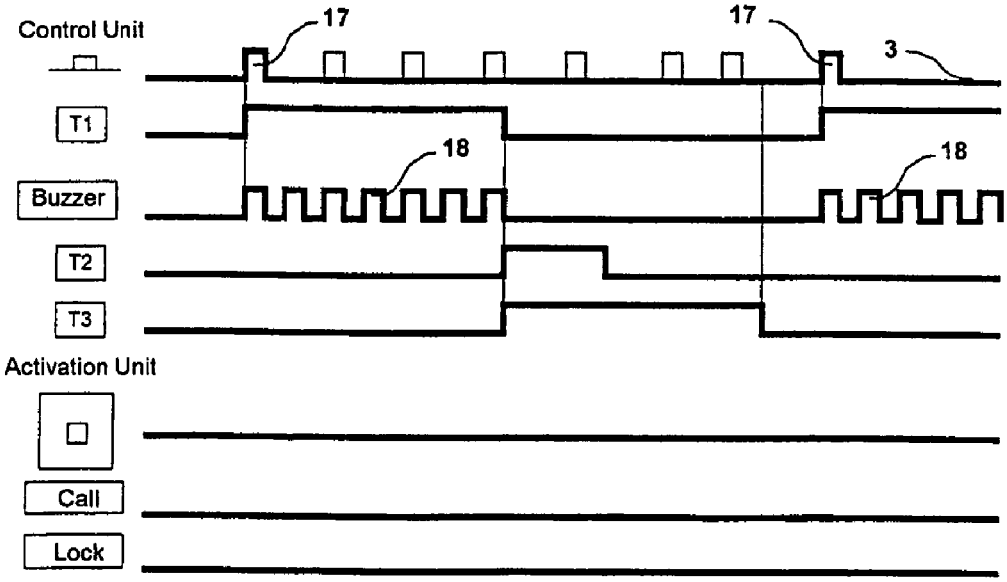
Figure 5:
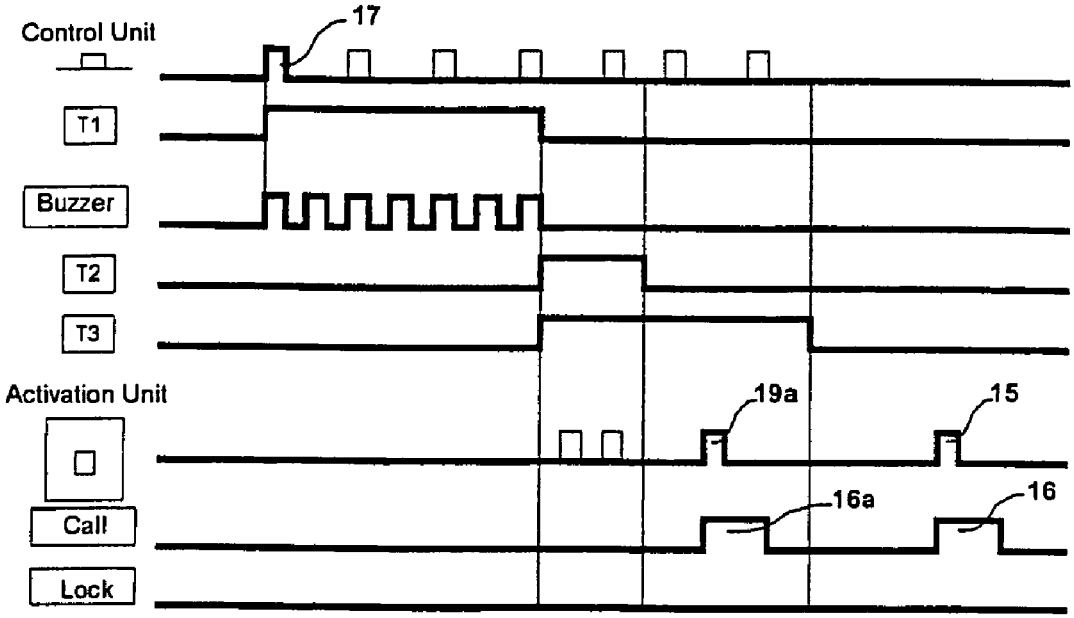

Referring to FIG. 5, it may be seen that represented therein is the case of FIG. 3, in which case however the unit 11 for activating the portable housing 8 is invoked after the timeout interval T1 but before the end of the security interval T3.

If the unit 11 for activating the portable housing 8 is invoked during the protection interval T2, this invoking has no effect.

As according to FIG. 4, if the unit 11 for activating the portable housing 8 is invoked after the end of the protection interval T2, the electronic circuit 9 of the portable housing 8 emits a control signal from the signalling device 7 so as to call for help as in the case described with reference to FIG. 2.

The modes of operation of the security system 1, such as are described hereinabove, may therefore be summarized in the following manner.

When the button 3*a* of the exterior control unit 3 is not invoked, any invoking of the unit 11 for activating the portable housing 8 gives rise to the activation of the device for signalling or for calling for help 7.

When the button 3*a* of the control unit 3 is invoked for a first time, any new invoking of this button is disabled for a duration equal at most to the addition of the timeout interval T1 and of the security interval T3. In the case where the unit 11 for activating the portable housing 8 is invoked during the timeout interval T1, the duration of this disabling is equal to the addition of the aforesaid duration t and of the security interval T3.

When the button 3*a* of the exterior control unit 3 is invoked, any activation of the device for signalling and for calling for help 7 is disabled for a duration equal at most to the addition of the timeout interval T1 and of the protection interval T2. In the case where the unit 11 for activating the portable housing 8 is invoked during the timeout interval T1, the duration of this disabling is equal to the addition of the aforesaid duration t and of the security interval T2.

Figure 6:
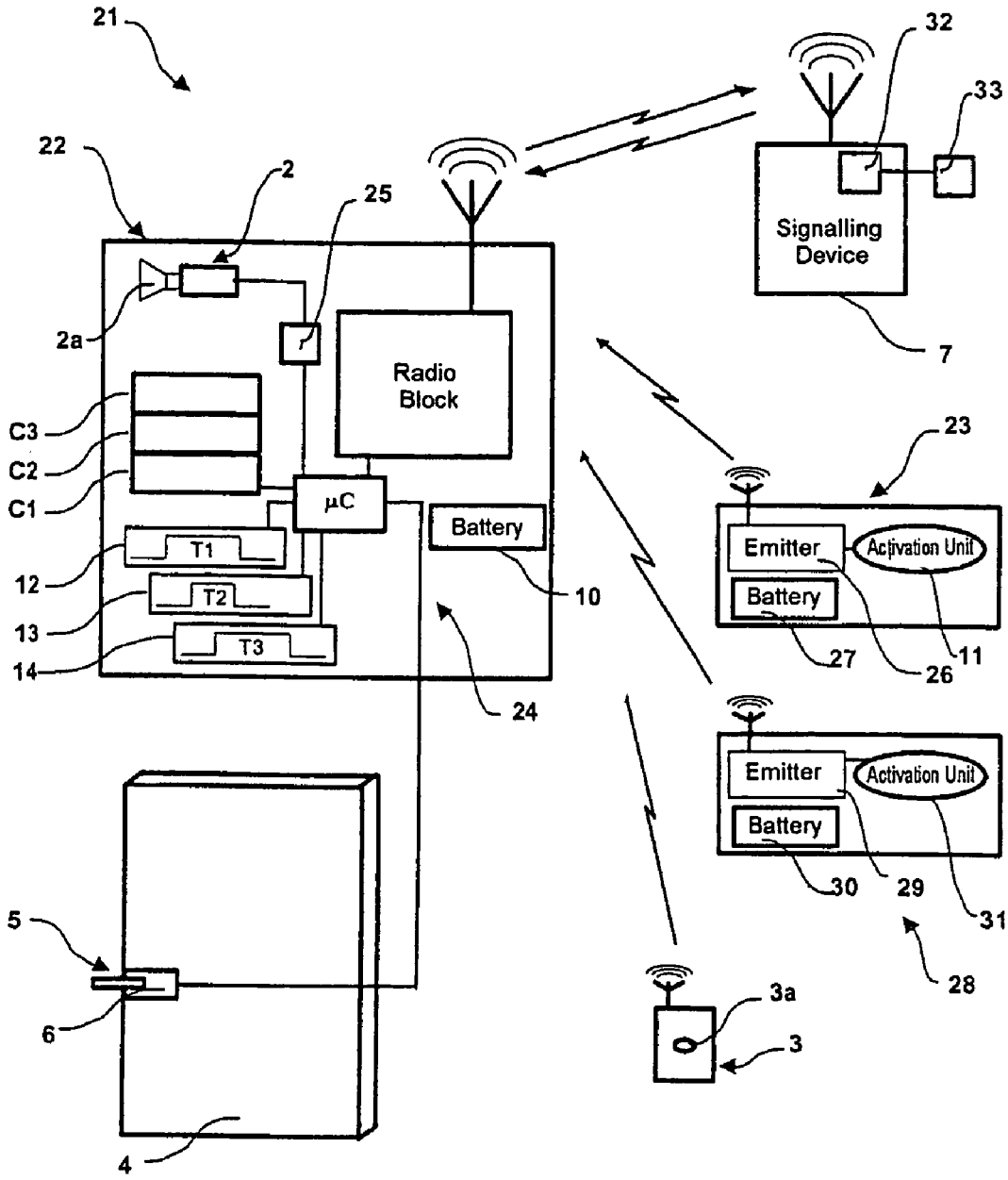
FIG. 6 represents a general diagram of a variant embodiment of the said security system.

Referring to FIG. 6, it may be seen that represented therein is a security system 21 different from the security system 1 just described in that it comprises on the one hand a fixed central facility 22 and on the other hand a portable housing 23, such as a pendant, that can easily be carried by a person as could the portable housing 8 and is linked by radio to the central facility 22, this central facility 22 and the portable housing 23 being functionally equivalent to the portable housing 8.

The central facility 22 comprises an electronic circuit 24 including a radio emitter/receiver and suitable for being subjected to a timeout interval T1, to a protection interval T2 and to a security interval T3 of a duration greater than the interval T2, these intervals optionally being adjustable.

In this example, a means of unlocking 6 carried by a door 4 is linked to the electronic circuit 24 by wire and the warning device 2, such as a buzzer, is also linked to the electronic circuit 24 by wire via a modulation adaptation circuit 25.

The portable housing 23 comprises an electronic circuit 26 including a radio emitter, powered by a cell 27, and to which an activation unit 11 such as a push button is linked.

The electronic circuit 24 of the central facility 22 is programmed to recognize the radio signal emitted by the portable housing 23 when this activation unit 11 is invoked, by comparison with an expected signal contained in a code memory C2.

Thus constructed, the security system 21 operates like the security system 1, in accordance with the timing charts of FIGS. 2 to 5.

As a supplement, the security system 21 can comprise at least one additional portable housing 28 that can be allocated to an authorized person.

This additional portable housing 28 comprises an electronic circuit 29 including a radio emitter, powered by a cell 30, and to which an activation unit 31 such as a push button is linked.

The electronic circuit 24 of the central facility 22 is programmed to recognize the radio signal emitted by the portable housing 28 when its activation unit 31 is invoked, by comparison with an expected signal contained in a code memory C3.

When the authorized person is outside the door 4 and invokes the unit 31 for activating his or her housing 28, the electronic circuit 24 of the central facility 22, having received and understood the signal emitted by this housing 28, despatches a control order to the circuit 6 for unlocking the door 4 to authorize the opening of the latter and at the same time commands the warning device 2 via the modulation adaptation circuit 25 so that the buzzer 2*a* emits a different sound from that which it emits subsequent to an invoking of the exterior housing 3, doing so in order to warn the occupant of the home of his or her entry.

Moreover, the signalling device may advantageously comprise a telephone transmitter 32 linked telephonically to a monitoring agency 33.

In the case where an authorized person is furnished with a portable housing specially coded to activate the telephone transmitter 32 via the central facility 22 programmed for this purpose and call this agency 33, an operator can optionally remotely actuate the means 6 for unlocking the door 4, via the telephone transmitter 32 and the central facility 22 programmed for this purpose, so as to allow the said person to enter the home.

The present invention is not limited to the examples described above. Many other variant embodiments of the invention are possible without departing from the scope defined by the appended claims.

The invention claimed is:

1. Process for operating a security system comprising a warning device (2) triggerable by a control unit (3), a unit (11) for activating a signalling device (7) and a means (6) of unlocking an electrically controlled lock (5), characterized in that it consists:

in activating a timeout unit when the control unit is invoked so as to engage a timeout interval (T1), in activating the means of unlocking the lock when the said activation unit is invoked during the timeout interval (T1), and in disabling the signalling device during the aforesaid timeout interval (T1) so that this signalling device can be activated only if the said activation unit is invoked outside of the timeout interval (T1).

2. Process according to claim 1, characterized in that a new timeout interval (T1) cannot be engaged until after the elapsing of a security interval (T3) subsequent either to an earlier timeout interval (T1) previously engaged when the said activation unit has not been invoked during the timeout interval (T1), or upon the activation of the means for unlocking the lock when the said activation unit has been invoked during the timeout interval (T1).

3. Process according to claim 1, characterized in that it consists in prolonging the disabling of the signalling device during a protection interval (T2) subsequent either to an earlier timeout interval previously engaged (T1) when the said activation unit has not been invoked during the timeout interval (T1), or upon the activation of the means for unlocking the lock when the said activation unit has been invoked during the timeout interval (T1).

4. Process according to claim 2, characterized in that the aforesaid protection interval (T2) is less than the aforesaid security interval (T3).

5. Process according to claim 1, characterized in that it consists in activating the said warning device (2) according to a different mode of operation and/or in activating the said unlocking means (6) when a supplementary control unit (28) is invoked.

6. Process according to claim 1, characterized in that the signalling device (7) is able to activate the said unlocking means (5) after having been invoked.

7. Process according to claim 3, characterized in that the aforesaid protection interval (T2) is less than the aforesaid security interval (T3).

* * * * *